US010020566B2

(12) United States Patent
Baek

(10) Patent No.: US 10,020,566 B2
(45) Date of Patent: Jul. 10, 2018

(54) MULTI-BAND MIMO ANTENNA FOR VEHICLE USING COUPLING STUB

(71) Applicant: HYUNDAI MOTOR COMPANY, Seoul (KR)

(72) Inventor: Ji Soo Baek, Gwangmyeong-si (KR)

(73) Assignee: Hyundai Motor Company, Seoul (KR)

( * ) Notice: Subject to any disclaimer, the term of this patent is extended or adjusted under 35 U.S.C. 154(b) by 37 days.

(21) Appl. No.: 15/183,256

(22) Filed: Jun. 15, 2016

(65) Prior Publication Data

US 2017/0170552 A1 Jun. 15, 2017

(30) Foreign Application Priority Data

Dec. 15, 2015 (KR) ..... 10-2015-0179007

(51) Int. Cl.

| | |
|---|---|
| ***H01Q 1/32*** | (2006.01) |
| ***H01Q 1/36*** | (2006.01) |
| ***H01Q 1/48*** | (2006.01) |
| ***H01Q 21/00*** | (2006.01) |
| ***H01Q 1/38*** | (2006.01) |
| ***H01Q 9/28*** | (2006.01) |
| ***H01Q 21/28*** | (2006.01) |

(52) U.S. Cl.

CPC ..... *H01Q 1/3275* (2013.01); *H01Q 1/36* (2013.01); *H01Q 1/38* (2013.01); *H01Q 1/48* (2013.01); *H01Q 9/285* (2013.01); *H01Q 21/00* (2013.01); *H01Q 21/28* (2013.01)

(58) Field of Classification Search

CPC ..... H01Q 1/3275; H01Q 1/36; H01Q 1/48; H01Q 5/364; H01Q 5/378; H01Q 9/42

See application file for complete search history.

(56) References Cited

U.S. PATENT DOCUMENTS

| | | | | |
|---|---|---|---|---|
| 6,396,456 B1 * | 5/2002 | Chiang | H01Q 1/38 | 343/700 MS |
| 8,928,537 B2 * | 1/2015 | Kerselaers | H01Q 1/3275 | 343/700 MS |
| 2009/0058758 A1 * | 3/2009 | Nishio | H01Q 1/2266 | 343/893 |
| 2012/0223862 A1 * | 9/2012 | Kerselaers | H01Q 1/3275 | 343/700 MS |

(Continued)

FOREIGN PATENT DOCUMENTS

| | | |
|---|---|---|
| KR | 10-2005-0084814 | 8/2005 |
| KR | 10-0697537 | 3/2007 |
| KR | 10-2009-0051964 | 5/2009 |

(Continued)

*Primary Examiner* — Hoang Nguyen

(74) *Attorney, Agent, or Firm* — Brinks Gilson & Lione

(57) ABSTRACT

Disclosed is a multi-band multiple-input/multiple-output (MIMO) antenna for a vehicle using a coupling stub, and an antenna system using the same. The multi-band MIMO antenna system includes a ground plate having a quadrangular planar shape, a first antenna mounted at one lateral edge of the ground plate while extending in a direction perpendicular to the ground plate, and a second antenna mounted at one longitudinal edge of the ground plate while extending in a direction perpendicular to the ground plate. In accordance with this configuration, the multi-band MIMO antenna system can support high isolation and wide high-frequency bandwidth.

14 Claims, 8 Drawing Sheets

(56) References Cited

U.S. PATENT DOCUMENTS

| | | | | |
|---|---|---|---|---|
| 2015/0061945 | A1* | 3/2015 | Chakam | H01Q 1/3275 343/713 |
| 2015/0236404 | A1* | 8/2015 | Choi | H01Q 5/10 343/722 |

FOREIGN PATENT DOCUMENTS

| | | | |
|---|---|---|---|
| KR | 10-1000129 | B | 12/2010 |
| KR | 10-2012-0139090 | | 12/2012 |
| KR | 10-2013-0052988 | | 5/2013 |
| WO | WO 2013-171240 | | 11/2013 |
| WO | WO 2014-072683 | | 5/2014 |

* cited by examiner

FIG. 3

310

| BAND | FREQUENCY BAND | REMARKS | BAND | FREQUENCY BAND | REMARKS |
|---|---|---|---|---|---|
| LTE 27 | 807 MHz ~ 869 MHz | NAR | LTE 4 | 1710 MHz ~ 2155 MHz | SKT, KT, LG U+,NAR |
| LTE 26 | 814 MHz ~ 894 MHz | NAR | LTE 10 | 1710 MHz ~ 2170 MHz | SKT, KT, LG U+,NAR |
| LTE 18 | 815 MHz ~ 875 MHz | Japan 800 Lower | LTE 9 | 1749 MHz ~ 1880 MHz | SKT, APAC |
| LTE 5 | 824 MHz ~ 894 MHz | SKT, LG U+, NAR | LTE 25 | 1850 MHz ~ 1995 MHz | SKT, KT, NAR |
| LTE 6 | 830 MHz ~ 885 MHz | SKT, LG U+, APAC | LTE 2 | 1850 MHz ~ 1990 MHz | SKT, KT, NAR |
| LTE 19 | 830 MHz ~ 890 MHz | Japan 800 Upper | LTE 1 | 1920 MHz ~ 2170 MHz | SKT, KT, LG U+, EMEA |
| LTE 8 | 880 MHz ~ 960 MHz | KT | LTE 23 | 2000 MHz ~ 2200 MHz | NAR |
| LTE 3 | 1710 MHz ~ 1880 MHz | SKT KT | | | |

320

| BAND | FREQUENCY BAND | REMARKS |
|---|---|---|
| LTE 33 | 1900 MHz ~ 1920 MHz | |
| LTE 34 | 2010 MHz ~ 2025 MHz | EMEA |
| LTE 35 | 1850 MHz ~ 1910 MHz | NAR |
| LTE 36 | 1930 MHz ~ 1990 MHz | NAR |
| LTE 37 | 1910 MHz ~ 1930 MHz | NAR |
| LTE 39 | 1880 MHz ~ 1920 MHz | China |

- APAC : Asia Pacific
- EMEA: Europe, Middle East and Africa
- NAR: North America Region

MULTI-BAND MIMO ANTENNA FOR VEHICLE USING COUPLING STUB

RELATED APPLICATION

This application claims the benefit of Korean Patent Application No. 10-2015-0179007, filed on Dec. 15, 2015, which is hereby incorporated by reference as if fully set forth herein.

BACKGROUND

Field of the Disclosure

The present disclosure relates to a multiple-input/multiple-output (MIMO) antenna for a vehicle, and more particularly to a multi-band MIMO antenna for a vehicle, which is capable of achieving an improvement in isolation and an enhancement in bandwidth, using a coupling stub.

Discussion of the Related Art

Recently developed wireless communication technologies realize the provision of voice communication services and high-quality multimedia services through a portable terminal for mobile communication and, as such, combination thereof with a next-generation wireless communication service such as long term evolution (LTE) is being highlighted.

Generally, communication systems based on voice communication services mainly use a single-input/single-output (SISO) system in which only a single antenna mainly having narrow-band channel characteristics is used within a limited frequency band. However, there are many difficulties in transmitting big data over a narrow-band channel, using the SISO system in which a single antenna is used. For this reason, further developed technology is needed.

To this end, next-generation wireless transmission technology, namely, multiple-input/multiple-output (MIMO) technology, in which a plurality of antennas is used in such a manner that each antenna operates independently, to achieve data transmission and reception at higher data transmission and reception rates while reducing possibility of generation of errors, is needed.

Such a MIMO system uses multiple antennas at transmission and reception stages thereof and, as such, realizes high-speed data transmission without an increase in frequencies allocated to the overall system. Accordingly, the MIMO system provides an advantage in that limited frequency resources can be efficiently used. By virtue of such an advantage, the MIMO system is applied to high-speed wireless packet data communication such as LTE or worldwide interoperability for microwave access (WiMAX).

However, the multiple antennas used in the MIMO system, namely, the MIMO antennas, should overcome degradation of transmission and reception performance caused by electromagnetic mutual coupling or insufficient isolation between adjacent antennas. In order to solve such problems, a method of spacing the adjacent antennas apart from each other by a distance of $\lambda/2$ or more ($\lambda$ being the wavelength of radio waves radiated by the antennas) may be proposed.

In a small-size antenna system, however, the above-mentioned problem cannot be solved by the method of spacing the adjacent antennas because the small-size antenna system has a limited antenna installation space.

Meanwhile, in accordance with development of communication technologies for vehicles, a vehicle antenna, which supports, in a vehicle, diverse wireless communication services associated not only with existing broadcast radio frequency signals such AM and FM signals, but also with digital multimedia broadcasting (DMB), global positioning system (GPS), and mobile communication, is being highlighted.

Such a vehicle antenna includes a glass antenna having a unified configuration of AM and FM antennas, and a shark fin antenna designed to enable services associated with, for example, GPS and Terrestrial-DMB (T-DMB). The antennas are installed inside and outside the vehicle, respectively.

In a conventional shark fin antenna, however, there may be problems in that, due to exposure thereof to the outside of the vehicle, the antenna may degrade the appearance of the vehicle, and may be damaged by external environments and external pressure. Furthermore, there is a difficulty in installing the antenna. In addition, during high-speed travel of the vehicle, noise may be generated as the antenna is struck by the wind.

Therefore, in the technical field to which the present invention pertains, development of an antenna capable of supporting a MIMO system to be built in a vehicle while having wide-band characteristics, and securing desired isolation and desired correlation is greatly required.

SUMMARY

Accordingly, the present disclosure is directed to a multi-band multiple-input/multiple-output (MIMO) antenna for a vehicle using a coupling stub that substantially obviates one or more problems due to limitations and disadvantages of the related art.

An object of the present disclosure is to provide a multi-band MIMO antenna for a vehicle, which is capable of achieving an enhancement in bandwidth of a high frequency band and an improvement in isolation, using a coupling stub.

Another object of the present disclosure is to provide a MIMO antenna for a vehicle capable of supporting a plurality of frequency bands.

Additional advantages, objects, and features of the forms and embodiments will be set forth in part in the description which follows and in part will become apparent to those having ordinary skill in the art upon examination of the following or may be learned from practice of the forms and embodiments. The objectives and other advantages of the forms and embodiments may be realized and attained by the structure particularly pointed out in the written description and claims hereof as well as the appended drawings.

To achieve these objects and other advantages and in accordance with the purpose of the forms and embodiments, as embodied and broadly described herein, a multi-band multiple-input/multiple-output (MIMO) antenna system for a vehicle includes a ground plate having a quadrangular planar shape, a first antenna mounted at one lateral edge of the ground plate while extending in a direction perpendicular to the ground plate, and a second antenna mounted at one longitudinal edge of the ground plate while extending in a direction perpendicular to the ground plate.

The multi-band MIMO antenna system may further include first and second feeding lines mounted to an upper surface of the ground plate, and connected to respective radiation bodies of the first and second antennas, and first and second feeding ports respectively mounted to edges of the ground plate other than the edges of the ground plate where the first and second antennas are mounted, the first and second feeding ports being connected to the first and second feeding lines, respectively.

The first and second antennas may include radiation bodies having the same pattern, respectively.

Each of the radiation bodies may be a single printed circuit board (PCB) type planar radiation body comprising a high-frequency band radiation body and a low-frequency band radiation body.

The multi-band MIMO antenna system may further include a stub mounted to one edge of the ground plate while extending straight in parallel to the single planar radiation body, the stub having a height proportional to a height of the high-frequency band radiation body.

The height of the stub may be 27 mm.

The single planar radiation body may be mounted to the ground plate such that the high-frequency band radiation body is closer to the ground plate than the low-frequency band radiation body.

The single planar radiation body may have a height of 54.5 mm and a width of 17 mm.

The ground plate may have a square structure having a length of 100 mm at each side thereof.

The high-frequency band radiation body may have a frequency transmission band of 1,650 to 2,280 MHz. The low-frequency band radiation body may have a frequency transmission band of 810 to 1,090 MHz.

The ground plate may have a dielectric constant of 4.4 and a thickness of 0.8 mm.

In another aspect of the present disclosure, a multi-band multiple-input/multiple-output (MIMO) antenna for a vehicle includes a printed circuit board, a single planar radiation body having an integrated structure of a high-frequency band radiation body and a low-frequency band radiation body formed on a single plane, the single planar radiation body being mounted to one surface of the printed circuit board, and a stub mounted to the surface of the printed circuit board while being spaced apart from one side of the high-frequency band radiation body by a predetermined distance.

The multi-band MIMO antenna may further include a connector for connecting the high-frequency band radiation body and the low-frequency band radiation body.

The multi-band MIMO antenna may further include a feeder connected to one side of the high-frequency band radiation body, and mounted to a ground plate.

The stub may have a height of 27 mm.

The single planar radiation body may have a height of 54.5 mm and a width of 17 mm.

The high-frequency band radiation body may have a frequency transmission band of 1,650 to 2,280 MHz. The low-frequency band radiation body may have a frequency transmission band of 810 to 1,090 MHz.

Multi-band MIMO antenna according to forms of the present disclosure and antenna systems using the same may provide the following effects.

In forms of the present disclosure, there is an advantage in that a multi-band MIMO antenna for a vehicle, which is capable of achieving an enhancement in bandwidth and an improvement in isolation, using a coupling stub, is provided.

In forms of the present disclosure, there is an advantage in that a multi-band MIMO antenna for a vehicle, which is capable of achieving an enhancement in bandwidth and an improvement in isolation in association with a high frequency band, uses a coupling stub.

In forms of the present disclosure, there is an advantage in that a MIMO antenna for a vehicle capable of supporting a plurality of frequency bands is provided.

It is to be understood that both the foregoing general description and the following detailed description of the present disclosure are exemplary and explanatory and are intended to provide further explanation of the invention as claimed.

BRIEF DESCRIPTION OF THE DRAWINGS

The accompanying drawings, which are included to provide a better understanding of the invention and are incorporated in and constitute a part of this application, illustrate forms and embodiment(s) of the disclosure and together with the description serve to explain the principle of the disclosure. In the drawings:

FIG. 3 is a table explaining details of LTE frequency bands allocated to Korean and foreign companies;

DETAILED DESCRIPTION

Reference will now be made in detail to forms of the present disclosure, examples of which are illustrated in the accompanying drawings. The suffixes "module" and "unit" of elements herein are used for convenience of description and thus can be used interchangeably and do not have any distinguishable meanings or functions.

Although all elements constituting forms of the present disclosure are described as being integrated into a single one or operated as a single one, the present disclosure is not necessarily limited to such forms. In some forms, all of the elements may be selectively integrated into one or more and be operated as one or more within the object and the scope of the present disclosure. Each of the elements may be implemented as independent hardware. Alternatively, some or all of the elements may be selectively combined into a computer program having a program module performing some or all functions combined in one or more pieces of hardware. Code and code segments constituting the computer program may be easily reasoned by those skilled in the art to which the present invention pertains. The computer program may be stored in computer readable media such that the computer program is read and executed by a computer to implement embodiments of the present invention. Computer program storage media may include magnetic recording media, optical recording media, and carrier wave media.

The term "comprises", "includes", or "has" described herein should be interpreted not to exclude other elements but to further include such other elements since the corresponding elements may be inherent unless mentioned otherwise. All terms including technical or scientific terms have the same meanings as generally understood by a person having ordinary skill in the art to which the present invention pertains unless mentioned otherwise. Generally used terms, such as terms defined in a dictionary, should be interpreted to coincide with meanings of the related art from the context. Unless obviously defined in the present invention, such terms are not interpreted as having ideal or excessively formal meanings.

It will be understood that, although the terms first, second, A, B, (a), (b), etc. may be used herein to describe various elements of the present invention, these terms are only used to distinguish one element from another element and intrinsic nature, order, or sequence of corresponding elements are not limited by these terms. It will be understood that when one element is referred to as being "connected to", "coupled to", or "accessed by" another element, one element may be "connected to", "coupled to", or "accessed by" another element via a further element although one element may be directly connected to or directly accessed by another element.

Figure 1:
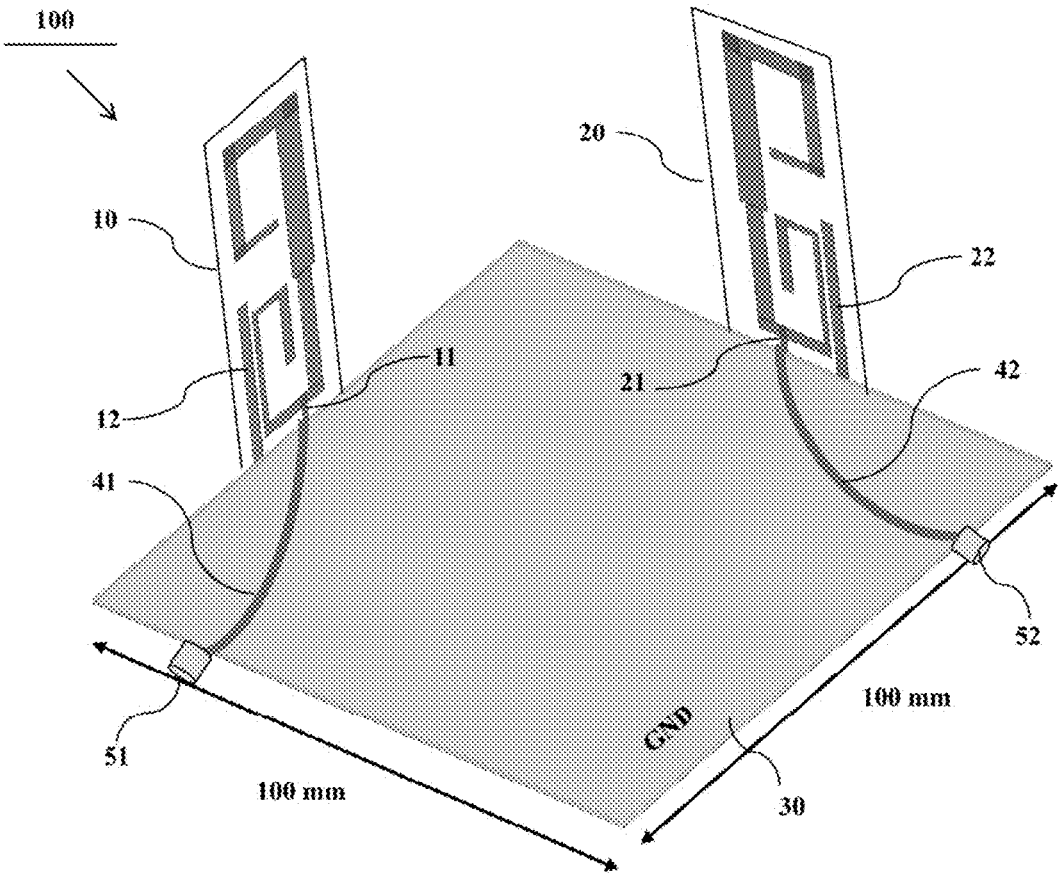
FIG. 1 is a view explaining a multi-band multiple-input/multiple-output (MIMO) antenna system for a vehicle.

FIG. 1 is a view explaining a multi-band multiple-input/multiple-output (MIMO) antenna system for a vehicle.

Referring to FIG. 1, the vehicle MIMO multi-band antenna system, which is designated by reference numeral "100" may include a first antenna 10, a second antenna 20, and a ground plate 30.

Each of the first antenna 10 and second antenna 20 may include a single printed circuit board (PCB) type planar radiation body. Here, the single planar radiation body may include an integrated structure of a high frequency band radiation body and a low frequency band radiation body.

In addition, each of the first antenna 10 and second antenna 20 may cover a frequency band defined by a long term evolution (LTE) standard. For example, the high frequency band radiation body has a frequency transmission band of 1,650 to 2,280 MHz, whereas the low frequency band radiation body has a frequency transmission band of 810 to 1,090 MHz As illustrated in FIG. 1, the first antenna 10 may be mounted at one lateral edge of the ground plate 30, which has a quadrangular planar shape, while extending in a direction perpendicular to the ground plate 30.

The second antenna 10 may be mounted at one longitudinal edge of the ground plate 30 while extending in a direction perpendicular to the ground plate 30.

In addition, the first antenna 10 and second antenna 20 may include a first feeder 11 and a second feeder 21, which are connected to the ground plate 30, respectively. In this case, each of the first and second feeders 11 and 21 may be connected to one side of the corresponding high frequency band radiation body and, as such, may be connected to the ground plate 30. Each of the first and second feeders 11 and 21 may also be connected to one end of a corresponding one of first and second feeding lines 41 and 42 mounted to an upper surface of the ground plate 30 for transfer of signals. In this case, each of the first and second feeding lines 41 and 42 may be connected, at the other end thereof, to a corresponding one of first and second feeding ports 51 and 52 respectively mounted to the remaining edges of the ground plate 30 other than the edges of the ground plate 30 where the first and second antennas 10 and 20 are mounted.

In particular, in the illustrated form of the present disclosure, the first antenna 10 and second antenna 20 may further include a first stub 12 and second stub 22 mounted in a direction perpendicular to the ground plate 30 while being spaced apart from the corresponding high frequency band radiation bodies by a predetermined distance, respectively.

In this case, the first and second stubs 12 and 22 may be used to achieve an increase in bandwidth of the high frequency band and an improvement in isolation in the MIMO system.

In some forms of the present disclosure, the ground plate 30 may have a square structure having lateral and longitudinal lengths of 100 mm. Of course, this structure is only exemplary. The structure of the ground plate 30 may be varied in accordance with the installation position of the vehicle multi-band MIMO antenna system according to the present invention on the vehicle and the kind of the vehicle. For example, the ground plate 30 may have an octagonal, diamond, parallelogram, or rectangular structure.

Meanwhile, in some forms of the present disclosure, the ground plate 30 has a dielectric constant of 4.4 and a thickness of 0.8 mm. Of course, these values are only exemplary. The ground plate 30 may have other values, if necessary.

As illustrated in FIG. 1, the first antenna 10 and second antenna 20 may be arranged such that signal radiation directions of the single planar radiation bodies thereof are perpendicular to each other. In this case, accordingly, interference between the first antenna 10 and the second antenna 20 may be minimized.

In particular, when the distance between the first antenna 10 and the second antenna 20 decreases, direct coupling between the radiation bodies of the first and second antennas 10 and 20 is strengthened and, as such, low-frequency band isolation characteristics may be degraded. On the other hand, when the distance between the first antenna 10 and the second antenna 20 increases, reinforced interference may be generated through the ground plate 30. Thus, when the distance between the first antenna 10 and the second antenna 20 is too great or too small, scattering coefficient characteristics may be degraded.

The first antenna 10 and second antenna 20 may be mounted at intermediate portions of the corresponding edges of the ground plate 30, respectively. Of course, the mounting positions of the first and second antennas 10 and 20 may be adjusted in accordance with results of experiments.

Figure 2:
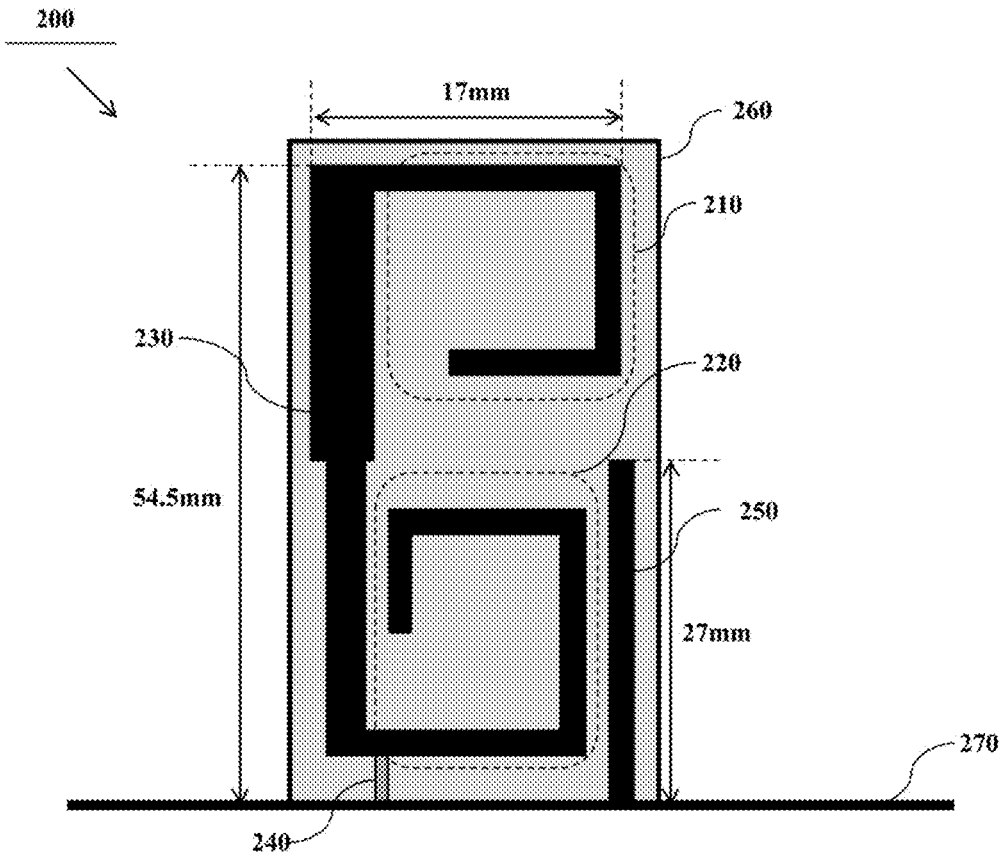
FIG. 2 is a view explaining a structure of a single printed circuit board (PCB) type planar MIMO antenna.

FIG. 2 is a view explaining a structure of the MIMO antenna.

As illustrated in FIG. 2, the MIMO antenna, which is designated by reference numeral "200", may include a single PCB type planar radiation body.

In detail, the MIMO antenna may include a low-frequency band radiation body 210, a high-frequency band radiation body 220, a connector 230, a feeder 240, a stub 250, and a PCB 260.

The low-frequency band radiation body 210 and high-frequency band radiation body 330 are connected to opposite ends of the connector 230 and, as such, may constitute a single planar radiation body structure.

As illustrated in FIG. 2, in the single planar radiation body structure, the high-frequency band radiation body 220 may be disposed near a ground plate 270.

The feeder 240 may be connected, at one end thereof, to one side of the high-frequency band radiation body 220. The other end of the feeder 240 may be connected to a feeding line (not shown) mounted to an upper surface of the ground plate 270.

The stub 250 may be disposed at a position spaced apart from the high-frequency band radiation body 220 by a predetermined distance. In this case, the stub 250 may be attached to or printed on the PCB 260. The stub 250 may be connected, at one end thereof, to the ground plate 270 while extending straight in perpendicular to the ground surface 270.

In some forms of the present disclosure, the single planar radiation body may have a size having a lateral length of 17 mm and a longitudinal length of 54.5 mm. Of course, this size is only exemplary. The size of the single planar radiation body may be varied in accordance with the kind of the vehicle, to which the MIMO antenna is applied, and the configuration of the MIMO antenna.

The size of the PCB 260, to which the single planar radiation body is attached or on which the single planar radiation body is printed, has no significant limitation. The PCB 260 may have any size, so long as the PCB 260 receives the single planar body and the stub 250.

In some forms of the present disclosure, the size of the stub 250 may be varied depending on the size of the high-frequency band radiation body 220. For example, the distance between the stub 250 and the high-frequency band radiation body 220 may be experimentally determined. In this case, the distance may be determined to have a value capable of maximally expanding the bandwidth of the high-frequency band while maximizing isolation between frequency bands (inter-band isolation). Here, the inter-band isolation may mean isolation between the high frequency band and the low frequency band.

In addition, the height of the stub 250 from the ground plate 270 may be proportional to the height of the high-frequency band radiation body from the ground plate 270. For example, the height of the stub 250 may be designed to be greater than the height of the high-frequency band radiation body from the ground plate 270 by "a". Here, the value of "a" may be experimentally determined. In this case, "a" may be determined to have a value capable of maximally expanding the bandwidth of the high-frequency band while maximizing inter-band isolation.

For example, the stub 250 has a length of 27 mm. Of course, this length is only exemplary. In practice, the length of the stub 250 may be varied in accordance with the size of the high-frequency band radiation body.

FIG. 3 is a table explaining details of LTE frequency bands allocated to Korean and foreign companies.

Reference numeral "310" designates details of frequency band allocations associated with an LTE frequency division duplex (FDD) system, and reference numeral "320" designates details of frequency band allocations associated with an LTE time division duplex (TDD) system.

LTE frequency bands defined by the 3rd Generation Partnership Project (3GPP) standard may be mainly divided into an 800 MHz band, an 1800 MHz band, and a 2000 MHz band. Here, the 800 MHz band is a low frequency band, whereas the 1800 MHz band and 2000 MHz band are high frequency bands.

For example, LTE frequency bands currently allocated to Korean mobile communication companies are as follows. To SKT, LTE bands 5 and 6 are allocated as low frequency bands, and LTE bands 1 to 4 and LTE bands 9, 10 and 25 are allocated as high frequency bands.

Of course, some LTE bands are commonly used by Korean mobile communication companies through bandwidth division. For example, LTE band 5 is used by SKT and LG U+. However, different frequency bands are allocated to companies associated with LTE band 5. That is, SKT is allocated 829 to 839 MHz (uplink)/847 to 884 MHz (downlink), and LG U+ is allocated 839 to 849 MHz (uplink)/884 to 894 MHz (downlink).

Referring to FIG. 3, it can be seen that the LTE low-frequency band currently allocated to Korean mobile communication companies is 824 to 960 MHz, and the LTE high-frequency band currently allocated to Korean mobile communication companies is 1,710 to 2,200 MHz.

Figure 4:
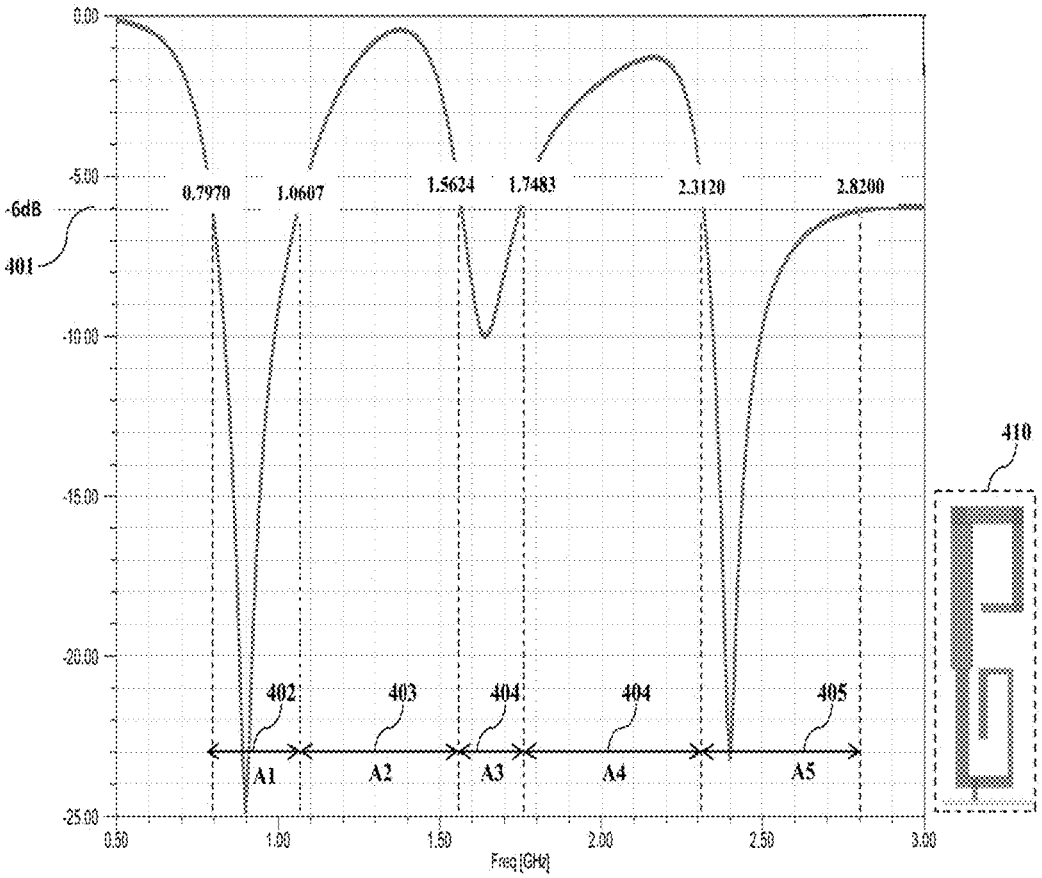
FIG. 4 is a graph depicting simulated results of reflection coefficient characteristics of a single PCB type planar MIMO antenna, which does not include a stub.

FIG. 4 is a graph depicting simulated results of reflection coefficient characteristics of a single PCB type planar MIMO antenna, which does not include the stub.

In detail, FIG. 4 shows reflection coefficient characteristics according to different frequency bands in a single PCB type planar MIMO antenna 410, which does not include a stub.

In a mobile communication system such as LTE/LTE-A, a desirable antenna reflection coefficient is equal to or less than a reference value of −6 dB (indicated by "401" in FIG. 4).

Referring to FIG. 4, the reflection coefficient characteristic curve of the single PCB type planar MIMO antenna 410, which does not include a stub, shows that the frequency band satisfying the reference value 401 of −6 dB or less in a low frequency band is an A1-band 402 of 797 to 1,060 MHz, and the frequency band satisfying the reference value 401 of −6 dB or less in a high frequency band is an A3-band 404 of 1,562 to 1,748 MHz or an A5-band 405 of 2,310 to 2,820 MHz. On the other hand, required reflection coefficient characteristics are not exhibited in an A2-band 403 and an A4-band 404.

Thus, it can be seen that the single PCB type planar MIMO antenna 410, which does not include a stub, satisfies a performance required for an LTE low frequency band, but cannot satisfy the performance reference value 401 of −6 dB in a certain LTE high frequency band.

In particular, the single PCB type planar MIMO antenna 410, which does not include a stub, has a problem in that a required performance is satisfied only in a certain bandwidth of the high frequency band of 1,710 to 2,220 MHz allocated to Korean mobile communication companies, namely, a bandwidth of about 180 MHz (A3, 1,562 to 1,748 MHz).

Figure 5:
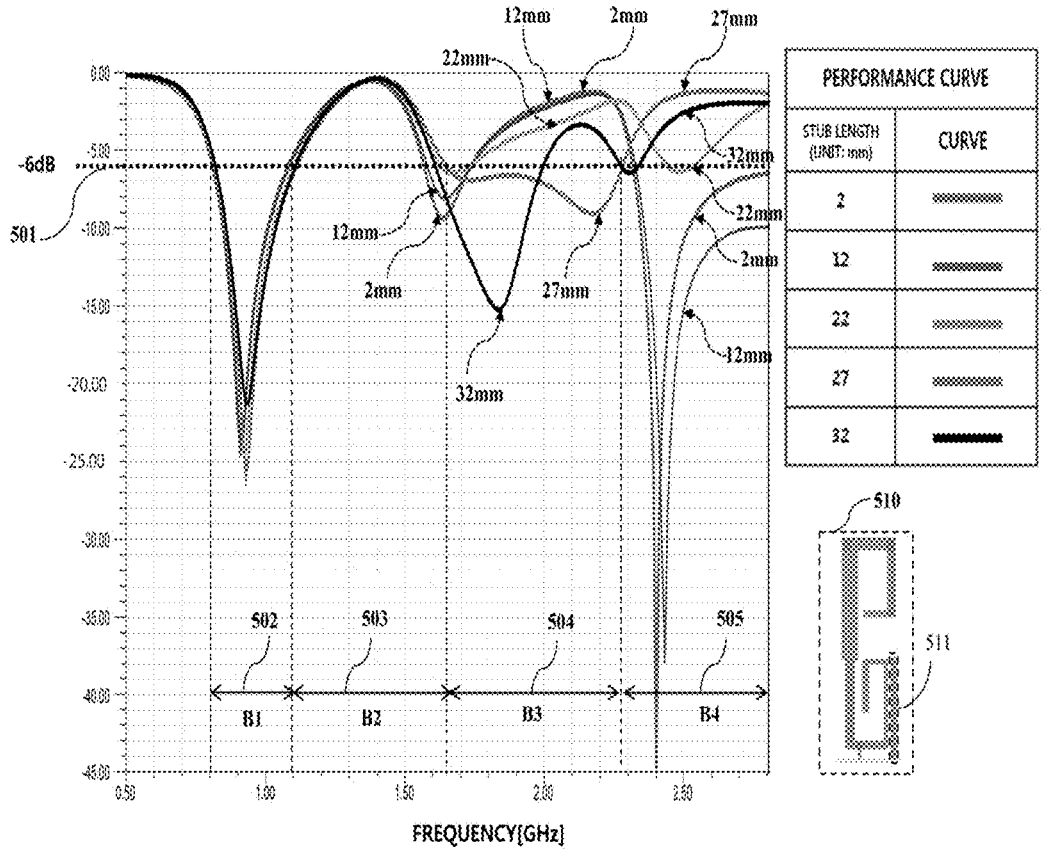
FIG. 5 is a graph depicting simulated results of reflection coefficient characteristics of a single PCB type planar MIMO antenna, which includes the stub, to show a variation in reflection coefficient characteristics according to a variation in length of the stub.

FIG. 5 is a graph depicting simulated results of reflection coefficient characteristics of a single PCB type planar MIMO antenna, which includes the stub, to show a variation in reflection coefficient characteristics according to a variation in length of the stub.

In detail, FIG. 5 shows reflection coefficient characteristics according to different frequency bands in a single PCB type planar MIMO antenna 510, which includes a stub 511.

In a mobile communication system such as LTE/LTE-A, a desirable antenna reflection coefficient is equal to or less than a reference value of −6 dB (indicated by "501" in FIG. 5).

Referring to FIG. 5, the reflection coefficient characteristic curve of the single PCB type planar MIMO antenna 510, which includes the stub 511, shows that the frequency band satisfying the reference value 501 of −6 dB or less in a low frequency band is a B1-band 502 of 700 to 1,100 MHz, irrespective of the length of the stub 511, and the frequency band satisfying the reference value 501 of −6 dB or less in a high frequency band is a B3-band 504 of 1,650 to 2,280 MHz when the length of the stub 511 is 27 mm. The reflection coefficient characteristic curve also shows that, when the length of the stub 511 is 27 mm, required reflection coefficient characteristics are not exhibited in a B2-band 503 and a B4-band 505. In this regard, the single PCB type planar MIMO antenna 510, which includes the stub 511 in accordance with the present invention, may support a maximum bandwidth of 630 MHz in an LTE high frequency band.

Thus, it can be seen that the single PCB type planar MIMO antenna, which includes a stub, satisfies a required performance not only for an LTE low frequency band, but also for an LTE high frequency band, so long as the stub length is 27 mm.

In particular, the single PCB type planar MIMO antenna, which includes a stub having a length of 27 mm, may not only satisfy a performance required for the overall high frequency band of 1,710 to 2,200 MHz allocated to Korean mobile communication companies, but also satisfy a performance required for LTE high frequency bands allocated to foreign mobile communication companies.

Figure 6:
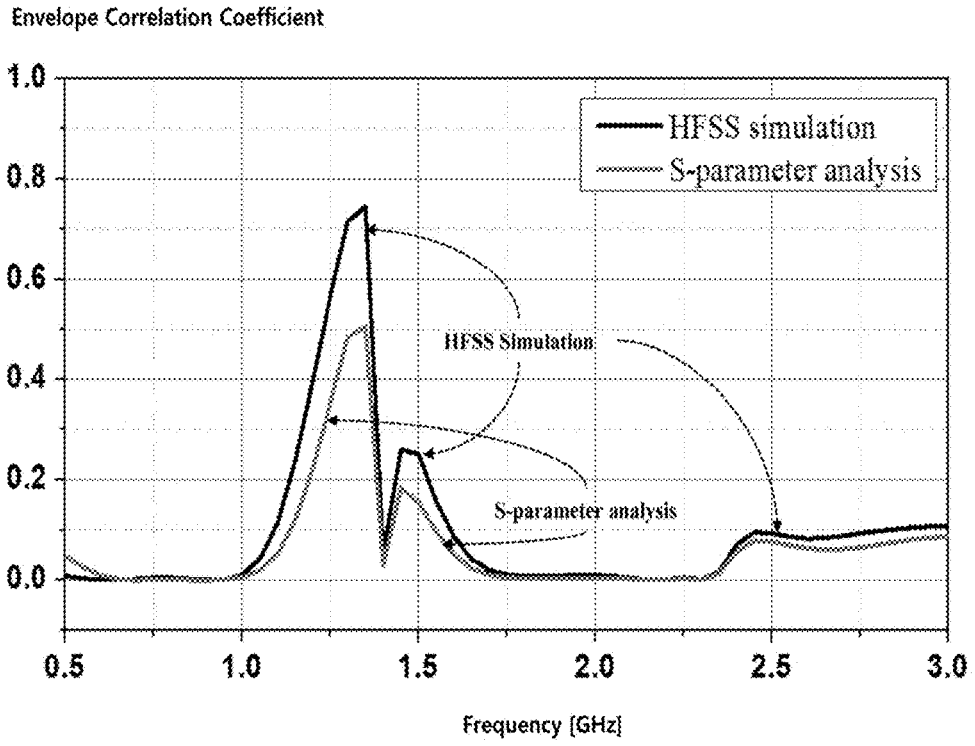
FIG. 6 is an envelope correlation coefficient curve of the stub-included single PCB type planar MIMO antenna.

FIG. 6 is an envelope correlation coefficient curve of the stub-included single PCB type planar MIMO antenna.

In detail, FIG. 6 is an envelope correlation coefficient curve of a single PCB type planar MIMO antenna including a stub having a length of 27 mm according to high frequency structure simulator (HFSS) simulation and S-parameter analysis.

Generally, envelope correlation coefficients (ECCs) of antennas are indices for analyzing, in a MIMO system having a plurality of antennas, influence of radiation patterns of the antennas on each other. An ECC closer to "0" means smaller interference between antennas. That is, a lower ECC means that the antennas have lower correlation.

As illustrated in FIG. 6, the envelope correlation coefficient curve shows that superior isolation characteristics of 0.5 or less are exhibited in the overall LTE frequency band.

Typically, in a MIMO antenna system, a required performance may be achieved at an envelope correlation coefficient of 0.5 or less.

Figure 7:
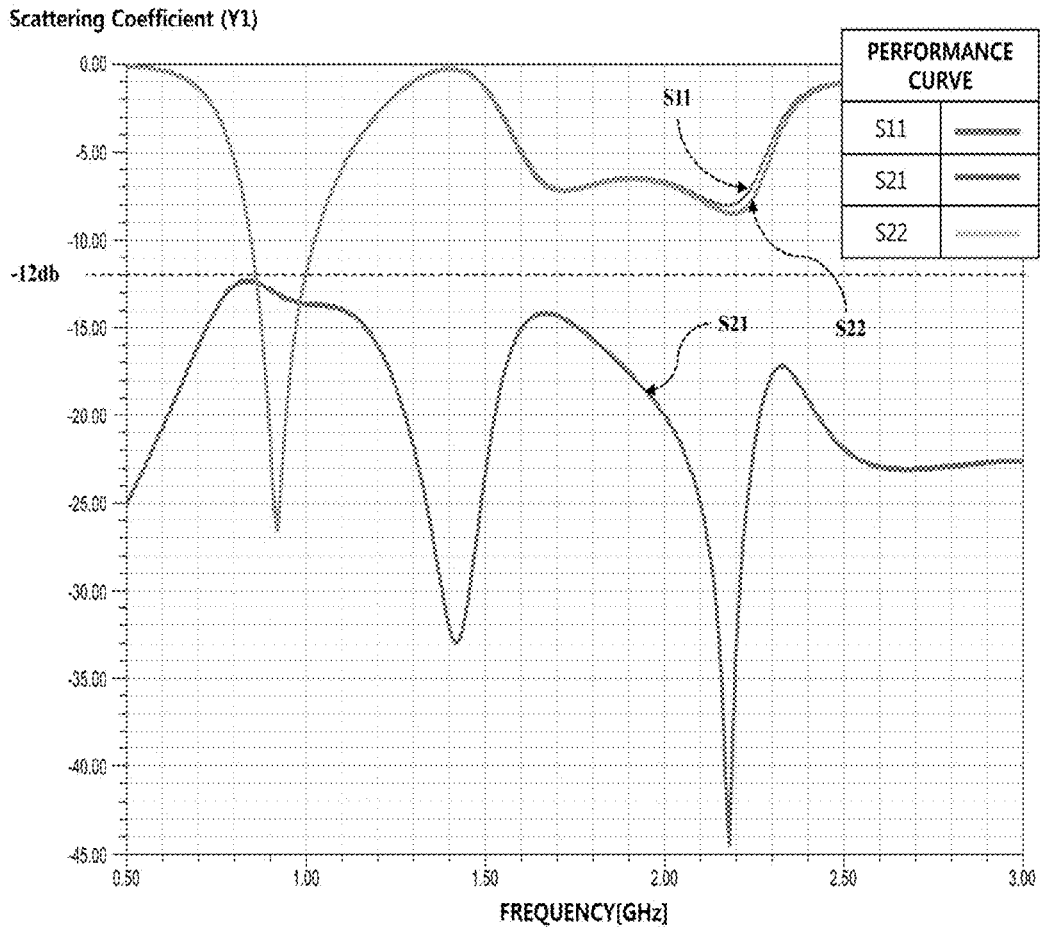
FIG. 7 is graph depicting results of an S-parameter analysis performed for a vehicle multi-band MIMO antenna.

FIG. 7 shows results of S-parameter analysis performed for a vehicle multi-band MIMO antenna according to an embodiment of the present invention.

In detail, FIG. 7 shows measured results of a scattering coefficient in the MIMO antenna system, which includes a first antenna and a second antenna.

In particular, the analyzed results of FIG. 7 are results of S-parameter analysis performed in the case in which a single PCB type planar MIMO antenna including a stub is used.

Generally, the scattering coefficient is a value calculated based on a scattering matrix. The scattering coefficient may be used as a value for measuring isolation characteristics between the first antenna and the second antenna.

As illustrated in FIG. 7, a scattering coefficient curve S21 for a signal transferred from a second antenna port to a first antenna port exhibits superior isolation characteristics of −12 dB or less in the overall LTE frequency band.

In addition, FIG. 7 shows that a scattering coefficient curve S11 representing a degree that the signal output from the first antenna port is input to the first antenna port and a scattering coefficient curve S22 representing a degree that the signal output from the second antenna port is input to the second antenna port exhibit superior isolation characteristics of −6 dB or less in the overall LTE frequency band.

Figure 8:
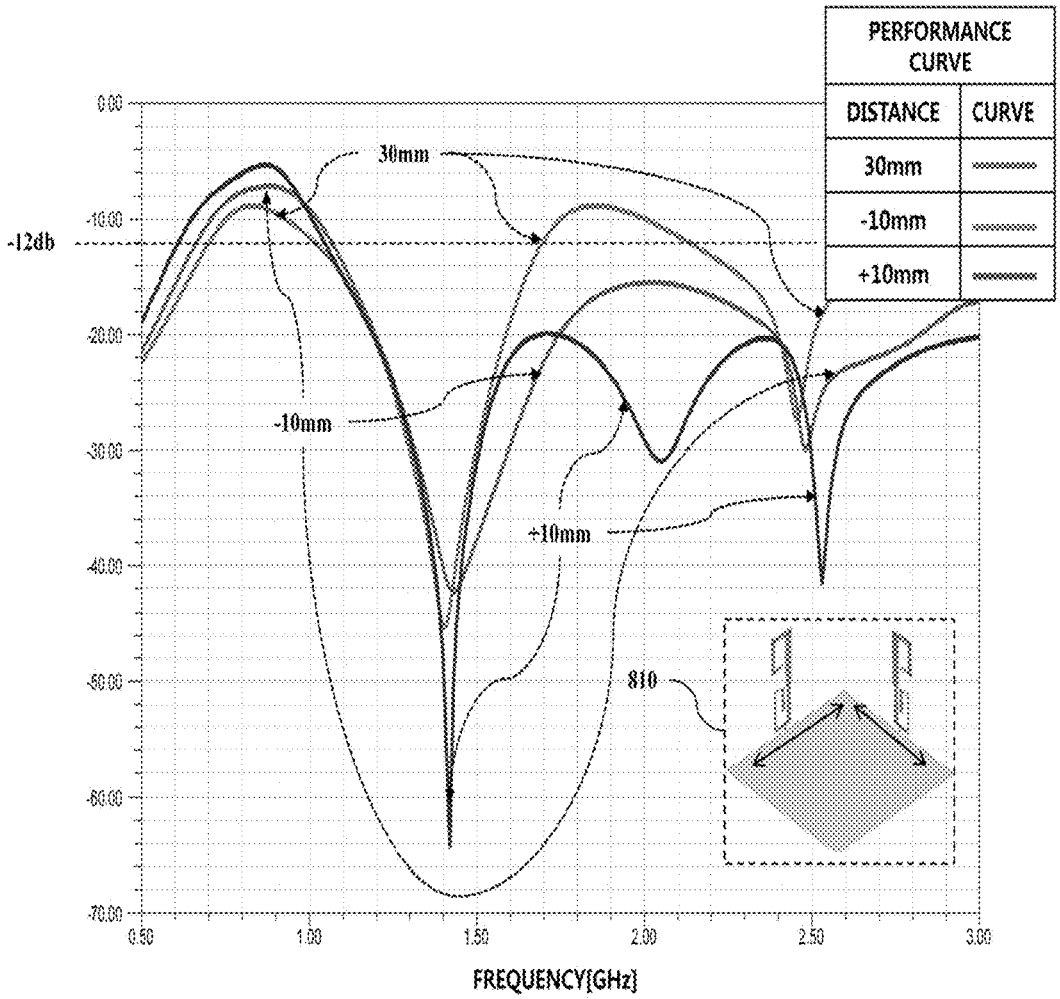
FIG. 8 is a graph depicting isolation characteristics depending on the distance between antennas in a vehicle multi-band MIMO antenna.

FIG. 8 is a graph depicting isolation characteristics depending on the distance between antennas in a vehicle multi-band MIMO antenna according to an embodiment of the present invention.

Experimental data in FIG. 8 shows a variation in isolation characteristics exhibited when first and second antennas centrally mounted to respective corresponding edges of a ground plate are moved in a left or light direction by a distance of 20 mm, as illustrated in a box 810.

In particular, FIG. 8 shows isolation characteristics exhibited in the case in which a single PCB type planar MIMO antenna, which does not include a stub, is used.

Referring to FIG. 8, it can be seen that isolation characteristics between the first antenna and the second antenna are degraded when the first and second antennas centrally mounted to respective corresponding edges of the ground plate are moved to be excessively farther from each other or to be excessively closer to each other, as illustrated in the box 810. Accordingly, in the vehicle multi-band MIMO antenna according to the illustrated form of the present disclosure, the mounting positions of the two antennas may preferably be determined such that the scattering coefficient between the two antennas is maintained at −12 dB in a desired LTE frequency band.

When the distance between the two antennas is too small, isolation characteristics in a low frequency band may be degraded because direct coupling between antenna radiation bodies is excessively strengthened. On the other hand, when the distance between the two antennas is too great, isolation characteristics in a low frequency band may be degraded because reinforced interference generated through the ground plate increases.

In the form of FIG. 8, however, it may be extremely difficult to achieve isolation characteristics required in an LTE frequency band due to reinforced and offset interference caused by an inappropriate antenna distance, only through adjustment of the positions of the antenna radiation bodies, differently than the embodiment of FIG. 7. To this end, it is preferable to apply an antenna radiation body including a stub to the MIMO antenna system, in addition to adjustment of the distance between two antenna radiation bodies, in order to achieve isolation characteristics satisfied in an LTE frequency band.

It will be apparent to those skilled in the art that various modifications and variations can be made in the present invention without departing from the spirit or scope of the inventions.

Thus, it is intended that the present disclosure cover the modifications and variations of this disclosure provided they come within the scope of the appended claims and their equivalents.

What is claimed is:

1. A multi-band multiple-input/multiple-output (MIMO) antenna system for a vehicle comprising:

a ground plate having a quadrangular planar shape;

a first antenna mounted at one lateral edge of the ground plate while extending in a direction perpendicular to the ground plate;

a second antenna mounted at one longitudinal edge of the ground plate while extending in a direction perpendicular to the ground plate; and a stub connected to one edge of the ground plate while extending straight in parallel to, and detached from, a single planar radiation body comprising the first antenna and the second antenna, wherein the single planar radiation body is part of a single printed circuit board (PCB) including a high-frequency band radiation body and a low-frequency band radiation body, and wherein a height of the stub is proportional to a height of the high-frequency band radiation body.

2. The multi-band MIMO antenna system according to claim 1, further comprising:

first and second feeding lines mounted to an upper surface of the ground plate, and connected to respective high-frequency band radiation bodies of the first and second antennas; and first and second feeding ports respectively mounted to edges of the ground plate other than the edges of the ground plate where the first and second antennas are mounted, the first and second feeding ports being connected to the first and second feeding lines, respectively.

3. The multi-band MIMO antenna system according to claim 1, wherein the first and second antennas comprise radiation bodies having the same pattern, respectively.

4. The multi-band MIMO antenna system according to claim 1, wherein the height of the stub is 27 mm.

5. The multi-band MIMO antenna system according to claim 1, wherein the single planar radiation body is mounted to the ground plate such that the high-frequency band radiation body is closer to the ground plate than the low-frequency band radiation body.

6. The multi-band MIMO antenna system according to claim 1, wherein the single planar radiation body has a height of 54.5 mm and a width of 17 mm.

7. The multi-band MIMO antenna system according to claim 1, wherein the ground plate has a square structure having a length of 100 mm at each side thereof.

8. The multi-band MIMO antenna system according to claim 1, wherein the high-frequency band radiation body has a frequency transmission band of 1,650 to 2,280 MHz, and the low-frequency band radiation body has a frequency transmission band of 810 to 1,090 MHz.

9. A multi-band multiple-input/multiple-output (MIMO) antenna for a vehicle comprising:

a printed circuit board;

a single planar radiation body having an integrated structure of a high-frequency band radiation body and a low-frequency band radiation body formed on a single plane, the single planar radiation body being mounted to one surface of the printed circuit board; and a stub connected to the surface of the printed circuit board while being spaced apart from, and detached from, one side of the high-frequency band radiation body by a predetermined distance, wherein a height of the stub is proportional to a height of the high-frequency band radiation body.

10. The multi-band MIMO antenna according to claim 9, further comprising:

a connector for connecting the high-frequency band radiation body and the low-frequency band radiation body.

11. The multi-band MIMO antenna according to claim 9, further comprising:

a feeder connected to one side of the high-frequency band radiation body, and mounted to a ground plate.

12. The multi-band MIMO antenna according to claim 9, wherein the stub has a height of 27 mm.

13. The multi-band MIMO antenna according to claim 9, wherein the single planar radiation body has a height of 54.5 mm and a width of 17 mm.

14. The multi-band MIMO antenna system according to claim 9, wherein the high-frequency band radiation body has a frequency transmission band of 1,650 to 2,280 MHz, and the low-frequency band radiation body has a frequency transmission band of 810 to 1,090 MHz.

* * * * *